United States Patent [19]

Jariwala et al.

[11] 3,983,442

[45] Sept. 28, 1976

[54] ELECTRON GUN CATHODE SUPPORT STRUCTURE

[75] Inventors: Praveen K. Jariwala, Hammondsport; Ernest F. Smart, Horseheads, both of N.Y.

[73] Assignee: Westinghouse Electric Corporation, Pittsburgh, Pa.

[22] Filed: May 19, 1975

[21] Appl. No.: 578,797

[52] U.S. Cl. ..... 313/251; 313/256; 313/417; 313/451; 313/456

[51] Int. Cl.[2] ..... H01J 1/88; H01J 19/42

[58] Field of Search ..... 313/417, 451, 256, 251, 313/284, 285, 286

[56] References Cited

UNITED STATES PATENTS

| | | | |
|---|---|---|---|
| 2,414,137 | 1/1947 | Branson | 313/286 X |
| 2,599,263 | 6/1952 | Law et al. | 313/284 X |
| 3,005,123 | 10/1961 | Griffiths | 313/451 |
| 3,128,407 | 4/1964 | Mattson | 313/451 |
| 3,319,102 | 5/1967 | Johnson | 313/451 |
| 3,333,138 | 7/1967 | Szegho | 313/451 |
| 3,351,792 | 11/1967 | Kuryla | 313/451 X |

*Primary Examiner*—Saxfield Chatmon, Jr.
*Attorney, Agent, or Firm*—W. G. Sutcliff

[57] ABSTRACT

The invention relates to an electron gun for a color television picture tube which has a rapid heating characteristic to produce electron emission in a short time. The indirectly heated electron emission portion of the cathode is supported from thin contoured support straps which provide a low thermal conductivity to the electron gun body.

3 Claims, 6 Drawing Figures

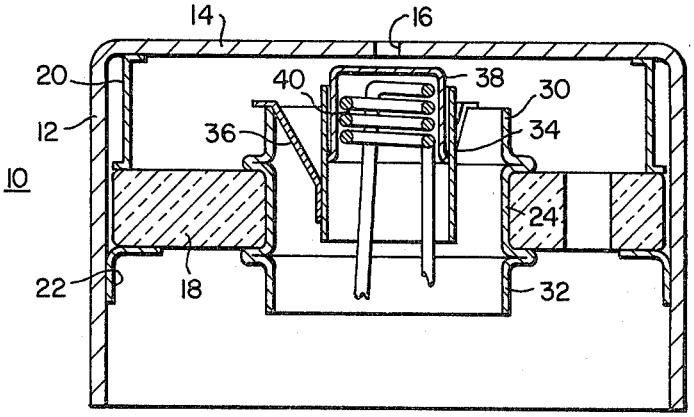
FIG.1
FIG.2
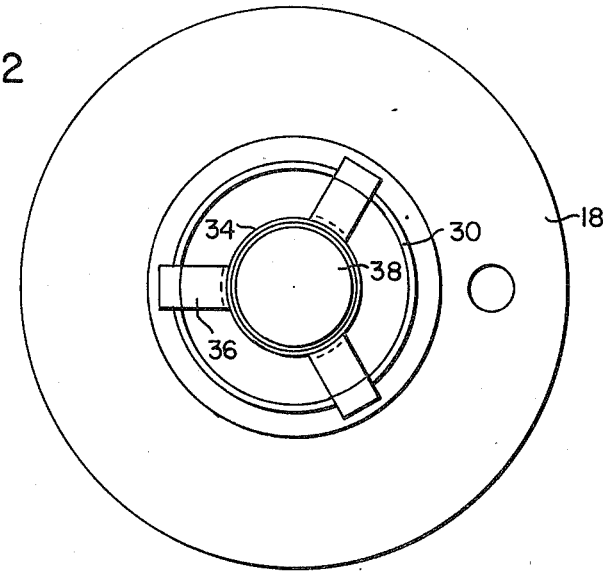
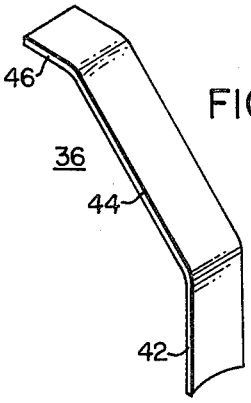
FIG.3
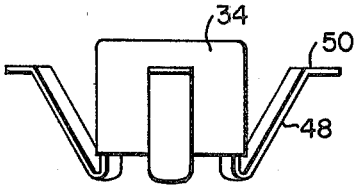
FIG.5
FIG.4
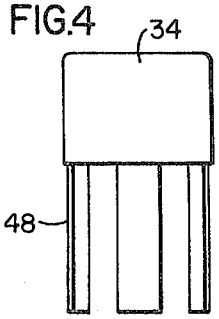
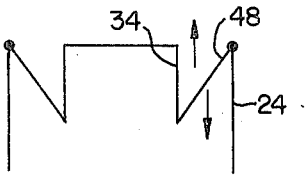
FIG.6

ELECTRON GUN CATHODE SUPPORT STRUCTURE

BACKGROUND OF THE INVENTION

The present invention relates to an electron gun component for a color television picture tube. In a television picture tube the electron beam generating emissive cathode must be heated to a finite temperature sufficient to produce a stream of electrons before the picture is visible upon set turn-on. A variety of schemes have been employed to reduce this on-set of electron emission, such as by continuously heating the cathode filaments to maintain the emissive portion near the temperature which will produce sufficient electron emission. Such systems are wasteful of energy in that they remain on even while the set is effectively not operating, and such systems have been criticized from a safety viewpoint. An alternative system has been proposed in which the emissive portion of the electron gun cathode has a low mass and is isolated from the rest of the electron gun body to limit thermal conduction away from the emissive portion and enable it to be heated with a minimum power input. Such electron gun components are shown in U.S. Pat. Nos. 3,333,138 and 3,354,340. In both of these prior art electron gun structures a cathode is shown in which an emissive cathode portion is spaced from the rest of the electron gun body by a plurality of thin, low thermal conductivity support members.

The positioning and spacing of the electron emissive cathode portion in such electron guns is very critical and any support system for spacing and supporting the emissive portion must provide sufficient rigidity and structural stability to insure that the alignment and spacing of the emissive portion is maintained. Improper alignment or spacing of the emissive portion can result in formation of poor picture clarity and discrimination.

In the aforementioned U.S. Pat. No. 3,333,138 the support strap structure is an elongated V-shaped body which extends well beyond the supporting sleeve within which the emissive cathode portion is disposed. In U.S. Pat. No. 3,354,340, the support sleeve is provided with a flanged surface to which the support strap end portion is welded and also the emissive cathode portion has a flange portion for connection to the support strap structure.

SUMMARY OF THE INVENTION

A rapid heating electron gun component comprises a disc-shaped insulator which is adapted to be accurately disposed within a cup-shaped G1 electron gun electrode. A rapid heating electron emissive cathode portion is suspended from this insulator structure. A disc-shaped insulator has a centralized aperture through the disc, and an elongated cylindrical support sleeve extends through the disc aperture, with the central portion of the support sleeve fitted within and engaged with the disc in the aperture. The elongated ends of the support sleeve extend beyond each side of the disc. A generally cylindrical cathode element is supported coaxially within support sleeve and has a closed electron emissive end portion projecting beyond one end of the support sleeve. A plurality of symmetrically spaced elongated support straps connect and support the cylindrical cathode element to the forward end of the support sleeve. Support straps are contoured with a predetermined radius of curvature to provide improved structural stability.

BRIEF DESCRIPTION OF THE DRAWINGS

FIG. 1 is an elevational view partly in section of the electron gun component of the present invention.

FIG. 2 is a plan view taken along lines 2—2 of FIG. 1 with the G1 cup-shaped grid removed or not in view.

FIG. 3 is enlarged prospective view of a single support strap.

FIG. 4 is a side elevational view of a portion of the electron gun component of the present invention in which the electron emissive cathode portion and the support straps are formed as a unitary body.

FIG. 5 is a view of the unitary member seen in FIG. 4, with the support straps bent upward for attachment to the support structure.

FIG. 6 is a schematic representation of the element seen in FIG. 5 as it would expand upon heating during operation, and is presented by explanation.

DESCRIPTION OF THE PREFERRED EMBODIMENT

Electron gun component 10 in FIG. 1 comprises the generally cup-shaped G1 electrode 12, having an enclosed end portion 14 at one end thereof, with an electron aperture 16 centrally formed therethrough. Electrode 12 is just a first of a series of focusing and controlling electrodes which are well known and conventionally used in electron guns used in color television picture tubes. An insulating disc 18 is disposed within the cup-shaped electrode 12. A spacer ring 20 is disposed between the insulating disc 18 and the interior surface of the end portion 14 of the electrode 12. Spacer ring 20 serves to accurately space the actual electron emission portion from the electron aperture 16. Retaining ring 22 is disposed within the cup-shaped electrode 12 abutting the insulating disc 18 and serving to retain it in contact with the spacer ring and prevent its movement.

Generally cylindrical support sleeve 24 is retained within a centralized aperture 26 provided through the insulating disc. Circumferential ridges 28 serve to engage the sleeve 24 to the insulating disc 18. Extending ends 30 and 32 of the sleeve 24 extend beyond the insulating disc 18. A cylindrical cathode element 34 is coaxially disposed within the sleeve 24 and connected thereto by a plurality of elongated support straps 36. The cylindrical cathode element 34 has a cup-shaped end closure 38 fitted within one end of element 34, the end portion of which closure 38 is covered with an electron emissive material. A heater coil 40 is disposed within the cylindrically cathode element 34, for heating the cathode to electron emissive temperature.

In the embodiment shown in FIG. 2, three symmetrically spaced support straps extend between one end of the cylindrical cathode element and forwardly extending end of the support sleeve 24. A single support strap 36 is seen in greater detail in FIG. 3. The support strap 36 comprises a thin radially contoured, low thermal conductivity material which has one end portion 42 which is fitted against the exterior surface of the cylindrical cathode element at the lower end portion thereof and is spot welded thereto. The support strap includes a central elongated, radially contoured portion 44 which serves to space the heated emissive portion of the cathode from the remainder of the electron gun body, and thereby limit the conductance of heat away from the emissive portion to facilitate rapid production of a display picture on the picture tube screen. The other terminating end 46 of the support strap is flat and bent at an angle which is approximately normal to the other extending end strap 42, to permit spot welding of the strap end 46 to the forwardly extending end surface of the support sleeve 24. By way of example, the support strap is formed of individual low thermal conductivity metal strips which are about 0.030 inch wide and about 0.002 inch thick. The end portion 42 of strap 36 which is fitted about and welded to the exterior of the cylindrical cathode portion extends for a distance of about 0.025 inch and the elongated portion 44 of the strap extends for a distance of about 0.045 inch, while the other end portion 46 extends for a distance of about 0.025 inch. The support strap is radially contoured along the length of strap portion 44, and has the same radius as the cylindrical cathode element, and is for example about 0.077 inch radius. The end portion 42 of the strap is radially contoured to fit the exterior surface of the cylindrical cathode element by the welding tool which welds end portion 42 to the cathode element. The contouring of the elongated portion 44 of the strap adds structure rigidity to this thin strap, which must support an accurately maintained emissive cathode portion in accurate alignment during tube operation, during which the emissive cathode element is heated to several hundred degrees centigrade.

In another embodiment of the invention seen in FIG. 4, the cylindrical cathode element 34 has unitary extending straps 48 which extend from the rear end of the cylindrical cathode element. Thus, the support strap portions are already contoured with the same radius as the cylindrical cathode element. This unitary structure is more easily fabricated and placed within the electron gun component by bending the straps 48 to permit welding to the forward end of the support sleeve.

This unitary structure is easily assembled into the cathode as seen in FIG. 5. The straps 48 are bent or looped back, and end portion 50 is flattened and spot welded to the extending end of sleeve 24. The radial contour of the elongated upwardly portion of the bent back straps 48 adds significant structural integrity to this otherwise fragile assembly.

The advantage of this unitary cylindrical cathode element support strap structure is illustrated in FIG. 6. The relative effective thermal expansion for this embodiment has two components. The cylindrical portion 34 will expand in a forward direction towards the electron aperture 16 of the G1 electrode 12. Since the strap 48 is fixed only at the front end of the support sleeve the entire strap is free to expand in the direction away from the electron aperture. Thus, the relative thermal expansions will tend to cancel each other out, so that the electron emissive portion of the cathode will remain in approximately the same plane during operation, which plane is accurately spaced from the electron aperture.

We claim:

1. An electron gun component comprising a disc-shaped insulator with a centralized aperture through the disc, an elongated cylindrical support sleeve the central portion of which is fitted within the disc aperture and engaged with the disc, with the elongated ends of the support sleeve extending beyond each side of the disc, a generally cylindrical cathode element supported coaxially within the support sleeve and having a closed electron emissive end portion projecting beyond one end of the support sleeve, a plurality of symmetrically spaced elongated support straps connecting and supporting the cylindrical cathode element to the forward end of the support sleeve, wherein the support straps are contoured to a predetermined radius for improved structural stability and wherein the contoured support straps comprise integral extensions from the open end of the cylindrical cathode element with the elongated strap being bent to extend toward the forward end of the support sleeve to which it is connected.

2. The electron gun component specified in claim 1, wherein the component is fitted and retained within a generally cup shaped first control electrode which has a centralized aperture through the closed end surface of the cup-shaped member, and wherein an annular spacer ring is disposed between the interior surface of the closed end and the insulator disc, and a retainer ring is disposed against the cylindrical interior side walls of the first control electrode abutting and biasing the insulator disc towards the closed end of the first control electrode.

3. The electron gun components specified in claim 1, wherein engagement ribs are provided in the support sleeve on each side of the insulator disc to engage the insulator disc.

* * * * *